US009857726B2

(12) United States Patent
Yoshioka

(10) Patent No.: US 9,857,726 B2
(45) Date of Patent: Jan. 2, 2018

(54) ACCUMULATION DEVICE AND IMAGE FORMING APPARATUS

(71) Applicant: FUJI XEROX CO., LTD., Tokyo (JP)

(72) Inventor: Sakae Yoshioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/236,642

(22) Filed: Aug. 15, 2016

(65) Prior Publication Data

US 2017/0269502 A1 Sep. 21, 2017

(30) Foreign Application Priority Data

Mar. 18, 2016 (JP) ..... 2016-055144

(51) Int. Cl.
*G03G 15/08* (2006.01)

(52) U.S. Cl.
CPC ..... *G03G 15/0831* (2013.01)

(58) Field of Classification Search
CPC ..... G03G 15/0831; G03G 21/12
See application file for complete search history.

(56) References Cited

U.S. PATENT DOCUMENTS 4,868,599 A * 9/1989 Niki ..... G03G 21/12 222/DIG. 1
5,594,535 A * 1/1997 Beaufort ..... G03G 15/0894 222/DIG. 1
9,063,460 B2 * 6/2015 Abler ..... G03G 15/0875

FOREIGN PATENT DOCUMENTS

JP 9-305080 A 11/1997
JP 2004-151238 A 5/2004

* cited by examiner

*Primary Examiner* — Gregory H Curran
(74) *Attorney, Agent, or Firm* — Sughrue Mion, PLLC

(57) ABSTRACT

An accumulation device includes a container, an expansion mechanism, and a detector. The container has an opening through which the container receives powder. The expansion mechanism includes a separator which separates an interior of the container into a first space where the powder dropped through the opening is accumulated and a second space where the powder dropped through the opening is not accumulated. The expansion mechanism allows the first space to be enlarged by changing a state of the separator. The detector detects the powder accumulated in the first space.

22 Claims, 10 Drawing Sheets

ACCUMULATION DEVICE AND IMAGE FORMING APPARATUS

CROSS-REFERENCE TO RELATED APPLICATIONS

This application is based on and claims priority under 35 USC 119 from Japanese Patent Application No. 2016-055144 filed Mar. 18, 2016.

BACKGROUND

Technical Field

The present invention relates to an accumulation device and an image forming apparatus.

SUMMARY

According to an aspect of the present invention, an accumulation device includes a container, an expansion mechanism, and a detector. The container has an opening through which the container receives powder. The expansion mechanism includes a separator which separates an interior of the container into a first space where the powder dropped through the opening is accumulated and a second space where the powder dropped through the opening is not accumulated. The expansion mechanism allows the first space to be enlarged by changing a state of the separator. The detector detects the powder accumulated in the first space.

BRIEF DESCRIPTION OF THE DRAWINGS

Exemplary embodiment of the present invention will be described in detail based on the following figures, wherein.

DETAILED DESCRIPTION

Figure 1:
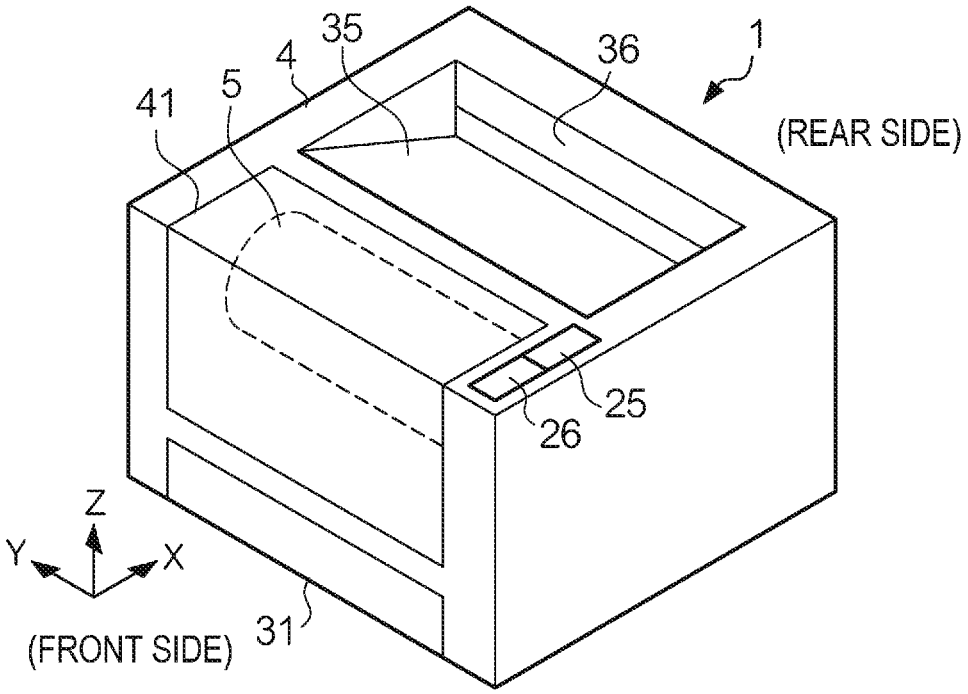
FIG. 1 is a perspective view of an image forming apparatus.
Figure 2:
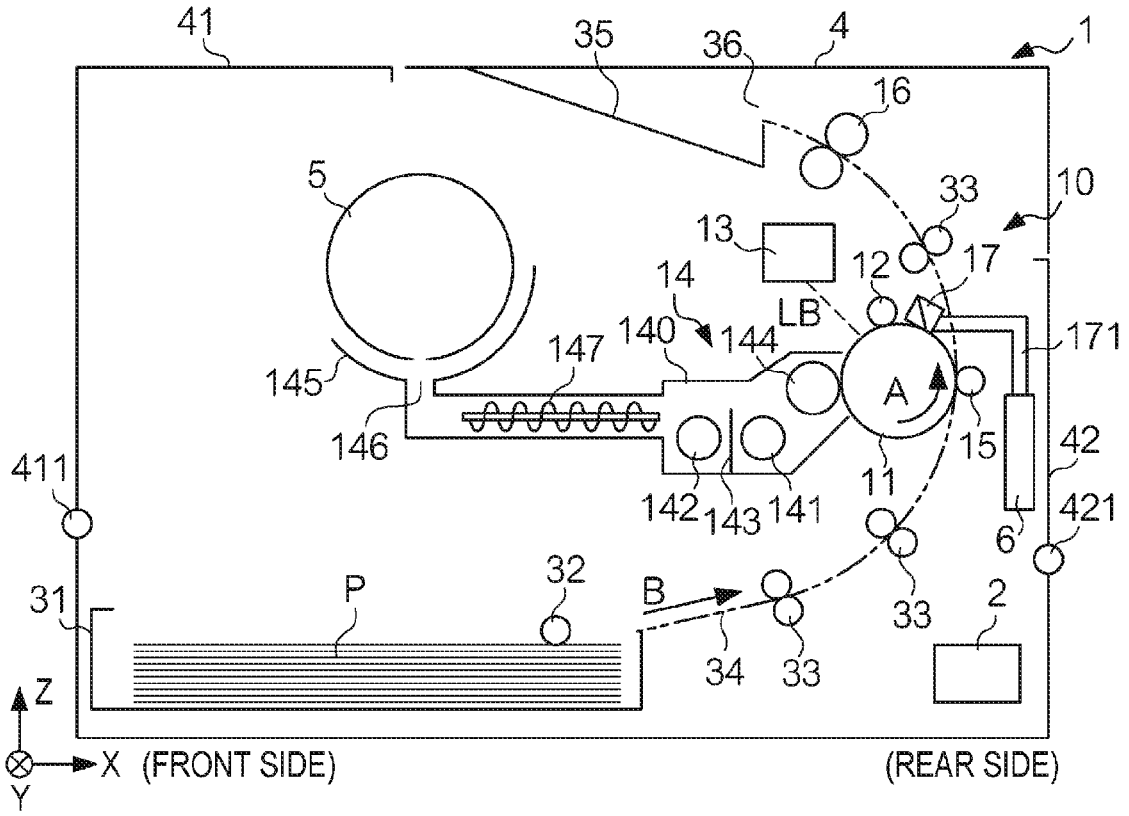
FIG. 2 is a right side view of the image forming apparatus.
Figure 3:
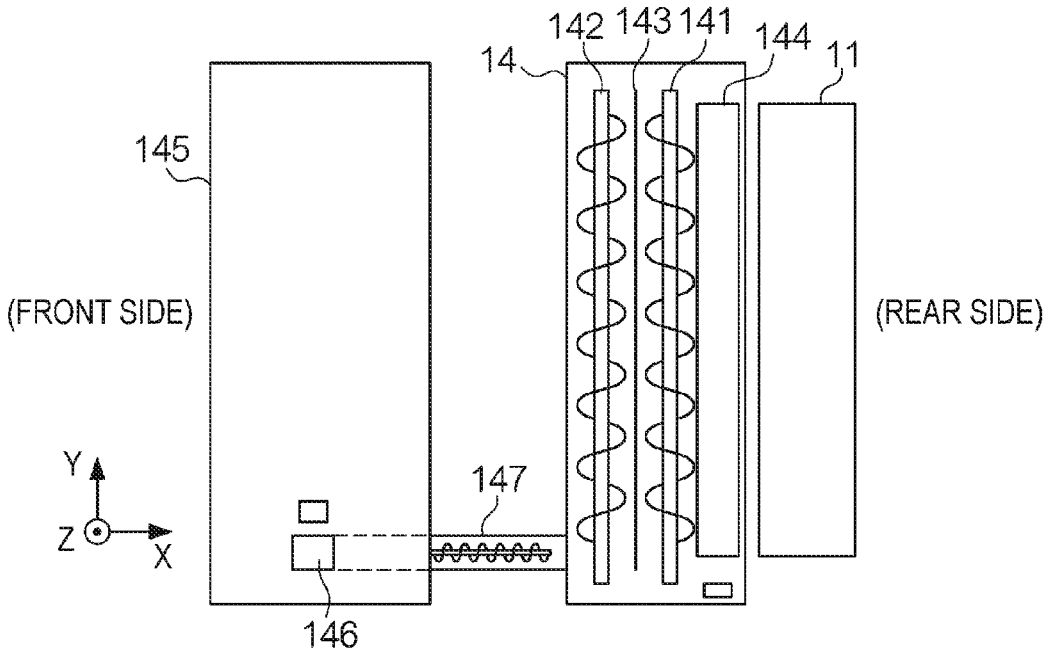
FIG. 3 is a plan view of a developing device.
Figure 4:
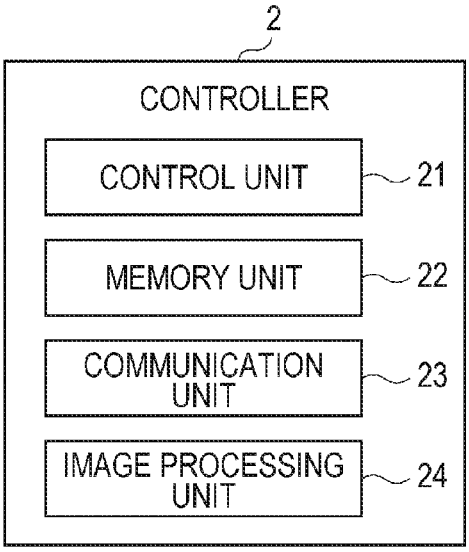
FIG. 4 illustrates a controller.

An example according to an exemplary embodiment of the present invention is described. FIG. 1 is a perspective view of an image forming apparatus 1. FIG. 2 is a right side view (see-through view in the +Y direction) of the image forming apparatus 1. FIG. 3 is a plan view (see-through view in the −Z direction) of a developing device 14. FIG. 4 illustrates a controller 2. For convenience, the front side and the rear side of the image forming apparatus 1 are defined as illustrated in the drawings in the following description. Also, a direction extending from the front side to the rear side of the image forming apparatus 1 is defined as the +X direction, a direction extending from the right side to the left side of the image forming apparatus 1 is defined as the +Y direction, and a direction extending from the lower side to the upper side of the image forming apparatus 1 is defined as the +Z direction.

The controller 2 includes a control unit 21, a memory unit 22, a communication unit 23, and an image processing unit 24. The control unit 21 includes computation devices such as a central processing unit (CPU) and storage devices such as a read only memory (ROM) and a random access memory (RAM). Firmware in which start-up procedures for hardware and an operating system (OS) are described is stored in the ROM. Data for performing computation by the CPU is stored in the RAM. The memory unit 22 includes, for example, a semiconductor memory, a hard disk drive, and the like. Software such as the OS and application programs are stored in the memory unit 22. The communication unit 23 includes a communication interface (I/F) for communication with an external electronic device and is connected to a communication line such as a local area network (LAN). The image processing unit 24 is an image processor that converts page description language (PDL) data and the like received from the communication unit 23 into raster data and performs image processing such as screening and color conversion on the raster data.

A display 25 includes, for example, a liquid crystal display device and displays a graphical user interface (GUI) screen on a display screen for operation of the image forming apparatus 1 performed by a user. A receiving unit 26 includes, for example, a touch panel provided so as to be superposed on the display screen of the display 25, a keypad provided at a position adjacent to the display screen, and the like. The receiving unit 26 receives an operation performed by the user and outputs to the control unit 21 a signal corresponding to the operation. The control unit 21 controls the image forming apparatus 1 in accordance with content of the operation.

A containing device 31 contains sheet-shaped recording media P such as sheets of paper stacked therein. The recording media P are fed one sheet after another to a transport path 34 by rotating a feed roller 32. Each of the recording media P is transported along the transport path 34 in a B direction by rotating transport rollers 33 provided in the transport path 34.

An image forming section 10 (an example of an image forming unit) includes, for example, the following components provided around a holding member 11: a charger 12; a drawing device 13; the developing device 14; and a transfer device 15. The holding member 11 holds a latent image drawn by the drawing device 13 and an image developed by the developing device 14. The holding member 11 is a cylindrical photosensitive member rotated in an A direction. A photosensitive layer is provided on the surface of the holding member 11. The photosensitive layer includes a semiconductor the potential of which changes when the semiconductor is irradiated with light. The charger 12 is, for example, a corotron-type charging device and charges the surface of the holding member 11 to a predetermined potential.

The drawing device 13 draws the latent image on the holding member 11. Specifically, the drawing device 13 generates a laser beam LB corresponding to gradations of pixels represented by the raster data supplied from the image processing unit 24 and radiates the laser beam LB to the holding member 11. The potential is reduced at portions of the holding member 11 irradiated with the laser beam LB, thereby the latent image is formed on the holding member 11.

The developing device 14 develops the latent image drawn on the holding member 11. A developing roller 144, a first transport member 141, a partition 143, and a second transport member 142 are disposed in this order from the holding member 11 side in a housing 140. A magnetic substance is attracted to the developing roller 144 by a magnetic force. The first transport member 141 is a screw including a spiral blade. The second transport member 142 is a screw that includes a spiral blade a spiral direction of which is reverse to that of the spiral blade of the first transport member 141. Outer circumferential surfaces of the developing roller 144 and the holding member 11 face each other on one and the other sides of an opening provided in the housing 140. Neither of ends of the partition 143 is connected to side walls of the housing 140. Thus, a transport channel extending around the partition 143 is formed.

Two-component developer that includes toner and carrier is contained in the housing 140. The toner includes resin powder colored by a coloring material. The carrier includes powder formed of a magnetic substance. When the first transport member 141 and the second transport member 142 are rotated, the two-component developer is triboelectrically charged by being agitated and transported so as to circulate the transport channel around the partition 143. When the two-component developer is transported to the first transport member 141, the two-component developer is attracted to the outer circumferential surface of the developing roller 144 being rotated. The attracted toner is charged by a developing bias voltage applied to the developing roller 144. The polarity to which the attracted toner is charged is opposite to the polarity to which the latent image is charged. As a result, the toner is transferred to the holding member 11, thereby the latent image is developed. Thus, a toner image is formed.

A toner cartridge 5 is attached to an attachment 145. The attachment 145 has a receiving port 146 through which the toner is received. The receiving port 146 and the housing 140 are connected to each other through a supply channel 147. The supply channel 147 is provided with a screw having a spiral blade. The toner is supplied to the housing 140 by rotating the screw. An opening/closing member 41 including a hinge 411 is provided on the front side of a housing 4. In order to replace the toner cartridge 5, the user opens the opening/closing member 41.

The transfer device 15 is provided at a position facing the holding member 11 with the transport path 34 interposed therebetween. A transfer bias voltage is applied to the transfer device 15. The polarity of the transfer bias voltage is opposite to the polarity to which the toner image on the holding member 11 is charged. Due to this transfer bias voltage, the recording medium P is charged. As a result, the toner image is transferred onto the recording medium P by electrostatic attraction.

A fixing device 16 includes a heating member and a pressure member. The heating member includes a heat source, and the pressure member is pressed against the heating member. The recording medium P is nipped between the heating member and the pressure member so as to fuse and apply pressure to the toner image, thereby the toner image is fixed onto the recording medium P. An opening 36 is provided in the housing 4 at the end of the transport path 34. The recording medium P onto which the toner image has been fixed by the fixing device 16 is output to an output portion 35 through the opening 36. The output portion 35 is a recess that is provided in an upper surface of the housing 4 and sized such that the recording medium P is received in the output portion 35.

The toner remaining on the holding member 11 after the toner image has been transferred onto the recording medium P is removed by a removing member 17. The removing member 17 includes, for example, a plate-shaped member. An end of the plate-shaped member is in contact with the holding member 11 so as to scrape off the toner from the holding member 11. The toner removed by the removing member 17 is accumulated in an accumulation unit 6. The removing member 17 and the accumulation unit 6 are connected each other through a discharge channel 171. The discharge channel 171 is provided with a screw having a spiral blade. The toner having been scraped off is discharged to the accumulation unit 6 by rotating the screw. An opening/closing member 42 including a hinge 421 is provided on the rear side of the housing 4. The user opens the opening/closing member 42 to perform operation on the accumulation unit 6. This operation performed by the user will be described later.

Figure 5A:
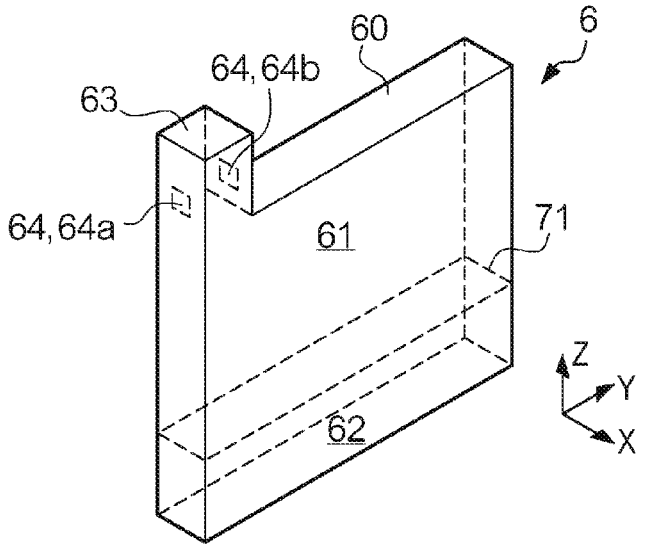
FIGS. 5A to 5C illustrate an accumulation unit.
Figure 5B:
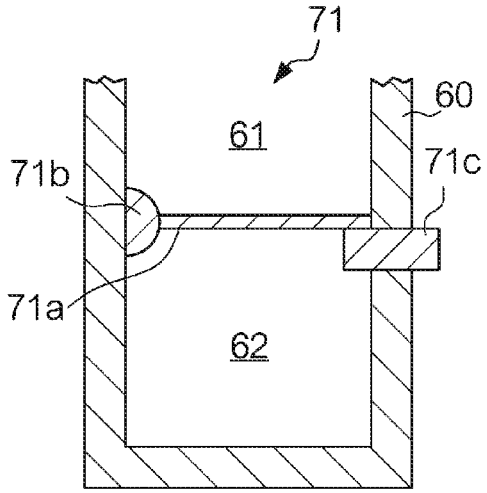
Figure 5C:
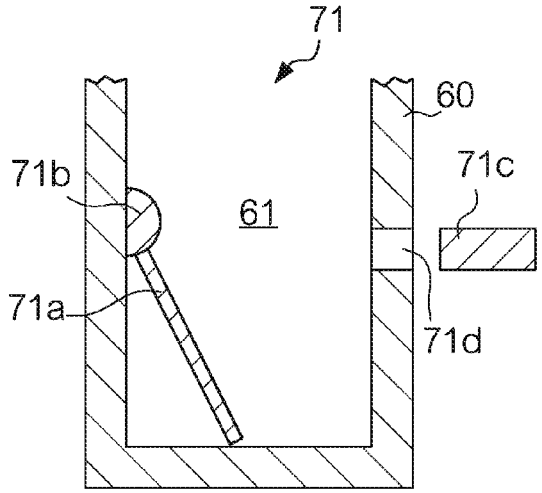

FIGS. 5A to 5C illustrate the accumulation unit 6. FIG. 5A is a perspective view of the entirety of the accumulation unit 6. FIGS. 5B and 5C are enlarged views (sectional views seen in the +Y direction) of an expansion mechanism 71. The accumulation unit 6 is an example of an accumulation device according to an exemplary embodiment of the present invention. The accumulation unit 6 includes a container 60, an opening 63, a detector 64, and the expansion mechanism 71. The container 60 may have any shape. The opening 63 is provided at an upper end of the container 60. The toner is received through the opening 63. The opening 63 may have any shape. The opening 63 may be provided at a lower position than that of the upper end of the container 60. In short, the opening 63 may be provided at any position as long as the toner is able to drop into the container 60 through the opening 63.

The expansion mechanism 71 includes a separator 71*a* that separates the interior of the container 60 into a first space 61 and a second space 62. The toner having dropped through the opening 63 is accumulated in the first space 61 and not accumulated in the second space 62. The first space 61 is expanded by changing a state of the separator 71*a*.

The separator 71*a* separates the interior of the container 60 into two spaces adjacent to each other in the Z direction. A space further to the upper side than the separator 71*a* is the first space 61, and a space further to the lower side than the separator 71*a* is the second space 62. The separator 71*a* is a plate-shaped member formed of resin or the like. One side (left side of, for example, FIGS. 5B and 5C) of the separator 71*a* is connected to an inner surface of the container 60 by a hinge 71*b*. The opposite side (right side of, for example, FIGS. 5B and 5C) of the separator 71*a* to the one side is supported by a pin 71*c* inserted into a hole 71*d* of a side surface of the container 60 (see FIG. 5B). When the user pulls out the pin 71*c*, the separator 71*a* is pushed open downward due to the weight of the accumulated toner. Thus, the first space 61 is expanded to the second space 62 side so as to allow the toner to drop (see FIG. 5C). The hinge 71*b* may have an ordinary hinge mechanism. Alternatively, for example, the one side of the separator 71*a* may be attached to the inner surface of the container 60 with tape or the like so as to obtain a function similar to that of the hinge.

The detector 64 detects powder accumulated in the first space 61. The detector 64 is, for example, a photo-interrupter that includes a light emitter 64*a* and a light receiver 64*b*. The light emitter 64*a* emits light that crosses the first space 61. The light receiver 64*b* receives the light emitted by the light emitter 64*a*. The light receiver 64*b* outputs a signal to the controller 2. This signal indicates different levels corresponding to the presence and absence of light reception. Only a single set of the detector 64 is provided at a position that is not lowest in the first space 61 (that is, a higher position than the lowest space in the first space 61). With this structure, the fact that the level of the powder accumulated in the first space 61 has reached a threshold is detected.

Figure 6:
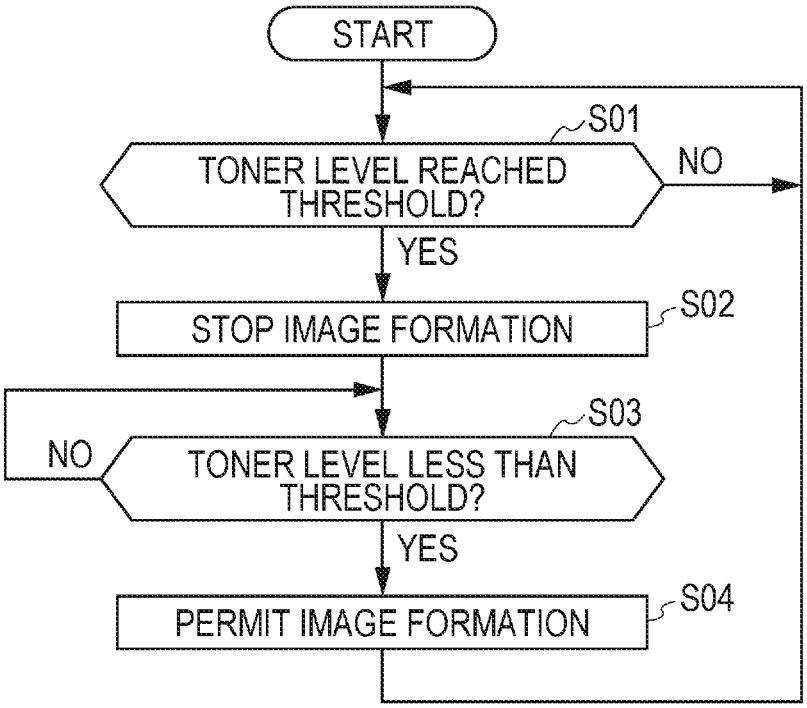
FIG. 6 is a flowchart illustrating a control procedure of the accumulation unit.

FIG. 6 is a flowchart illustrating a control procedure of the image forming apparatus 1. A program in which the control procedure is described is installed in the controller 2. When the control unit 21 executes this program, the following processes are performed.

Step S01

The control unit 21 determines if the level of the toner has reached the threshold or not. Specifically, when the toner accumulated in the first space 61 reaches the passage of the light, the light is interrupted by the toner, and accordingly, the light receiver 64*b* does not receives the light. The level of the passage of the light at this time is the threshold. When the state of the light receiver 64*b* changes from a light-receiving state to a non-light-receiving state as described above, the control unit 21 determines that the level of the toner has reached the threshold, and the processing performed by the control unit 21 advances to step S02.

Step S02

The control unit 21 causes the image formation to be stopped. Specifically, when the detector 64 detects that the level of the toner has reached the threshold, the control unit 21 causes the image formation performed by the image forming section 10 to be stopped. When the image formation is stopped, the toner is not discharged from the removing member 17. In other words, the process to stop the image formation is a process to stop the accumulation of the toner in the first space 61 of the accumulation unit 6. Furthermore, the control unit 21 causes a warning to be issued while causing the image formation to be stopped. For example, the control unit 21 causes the display 25 to display a message indicating that the container 60 is full.

Step S03

The control unit 21 determines if a specified event has occurred or not. Specifically, the control unit 21 determines if the level of the toner is less than the threshold (the same as the threshold in step S01) or not. The level of the toner becomes less than the threshold when, for example, the first space 61 is expanded or the container 60 is replaced. The expansion of the first space 61 and the replacement of the container 60 are performed by the user.

Figure 7:
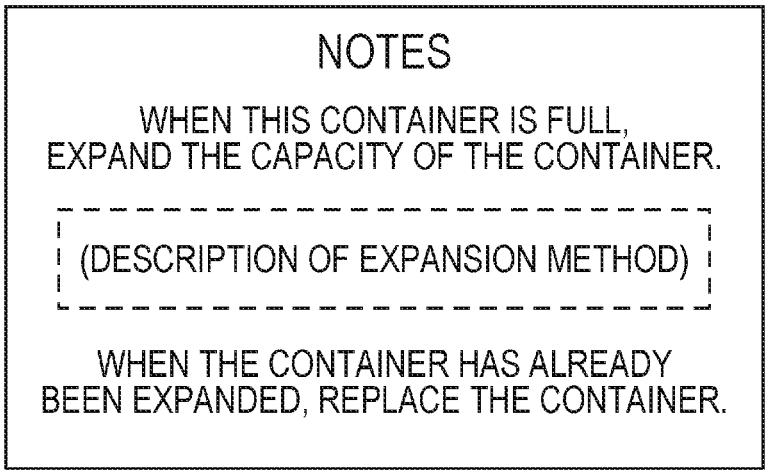
FIG. 7 illustrates examples of notes.

FIG. 7 illustrates examples of notes. The notes are provided at a position such as a side surface of the container 60, a front or rear surface of a door of the opening/closing member 42, or a position of a surface of the housing 4 adjacent to the opening/closing member 42. The notes may be printed on a label and bonded to the above-described position or directly printed on the above-described position. In this example, the following notes are presented: "WHEN THIS CONTAINER IS FULL, EXPAND THE CAPACITY OF THE CONTAINER"; "(DESCRIPTION OF EXPANSION METHOD)"; and "WHEN THE CONTAINER HAS ALREADY BEEN EXPANDED, REPLACE THE CONTAINER". However, any wording of the same or similar meaning may be used. Description of a specific example of an expansion method as will be described later is written in the above-described "(DESCRIPTION OF EXPANSION METHOD)" part. In the notes, "CAPACITY" means the capacity of the first space 61. The user having been notified by the message displayed in the display 25 that the container 60 is full opens the opening/closing member 42, determines whether to expand the first space 61 or replace the container 60, and performs the determined operation in accordance with the notes.

(1) Expansion of the First Space

In the case where the first space 61 has not been expanded, the user performs operation to expand the first space 61 with the expansion mechanism 71. As a result, the toner drops in the container 60 and the light emitted by the light emitter 64*a* is not interrupted by the toner. When the state of the light receiver 64*b* changes from the non-light-receiving state to the light-receiving state as described above, the control unit 21 determines that the level of the toner is less than the threshold.

(2) Replacement of the Container

In the case where the first space 61 has been expanded, the user replaces the container 60. Since a new container 60 is empty, the light emitted by the light emitter 64*a* is not interrupted by the toner. When the state of the light receiver 64*b* changes from the non-light-receiving state to the light-receiving state as described above, the control unit 21 determines that the level of the toner is less than the threshold. Also in the case where the first space 61 has not been expanded, the container 60 may be replaced.

When it is determined that the level of the toner is less than the threshold (YES in step S03), the processing of the control unit 21 advances to step S04.

Step S04

The control unit 21 permits the image formation. Specifically, when the detector 64 detects that the level of the toner is less than the threshold, the control unit 21 permits the image formation performed by the image forming section 10. When the image formation is permitted, the toner is discharged from the removing member 17 in the case where the image formation is performed. In other words, the process in which the control unit 21 permits the image formation is a process to permit the accumulation of the toner in the first space 61 of the accumulation unit 6.

Thus, the control procedure has been described.

As has been described, according to the present exemplary embodiment, when the level of the toner accumulated in the first space first reaches the threshold (referred to as "first stage" hereafter), the user expands the first space with the expansion mechanism. After that, according to the present exemplary embodiment, when the level of the toner accumulated in the first space reaches the threshold again (referred to as "second stage" hereafter), the user replaces the container. With the detection of the amount of the toner at two stages as described above, it is sufficient that the replacement container be prepared during time between the first stage and the second stage. Thus, even when there is no replacement container near the user at the time of the detection at the first stage, the image formation is not necessarily stopped for preparation of the container.

Furthermore, according to the present exemplary embodiment, the amount of the toner accumulated in the container is detected at two stages, that is, the first stage and the second stage with the toner detector only at a single position. Thus, according to the present exemplary embodiment, compared to the case where the expansion mechanism is not used, detection of the amount of powder accumulated in the container at plural stages is realized with the simple detector. The cost of the structure according to the present exemplary embodiment may be reduced compared to a structure in which, for example, toner detectors are provided at two positions of different levels. Furthermore, with a system in which a toner detector is provided at a position lower than a level reached when the container is full and in which timing at which the container becomes full is predicted, it is required that accuracy in prediction be verified. However, a device for prediction is not required according to the present exemplary embodiment.

The above-described exemplary embodiment may be changed to the following variations. Also, plural variations may be combined with one another.

First Variation

Figure 8A:
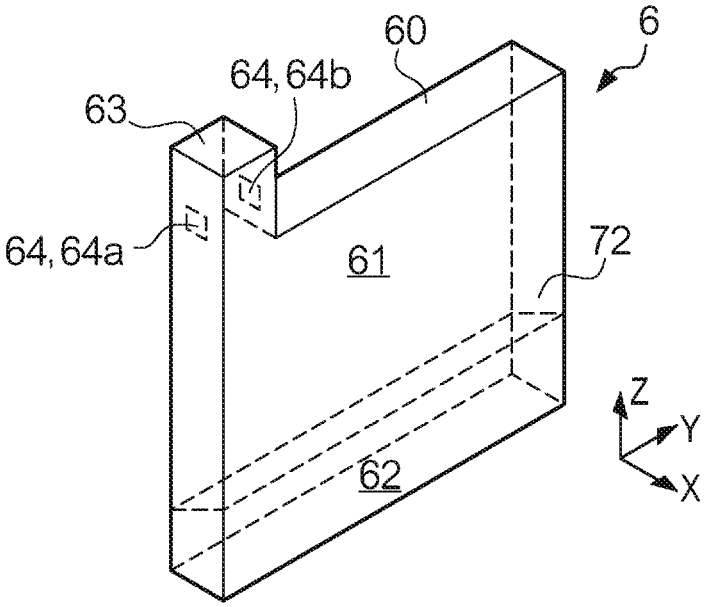
FIGS. 8A to 8C illustrate a variation of an expansion mechanism.
Figure 8B:
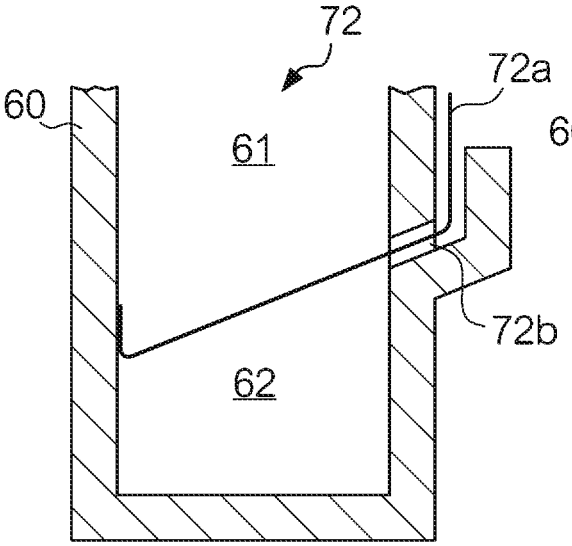
Figure 8C:
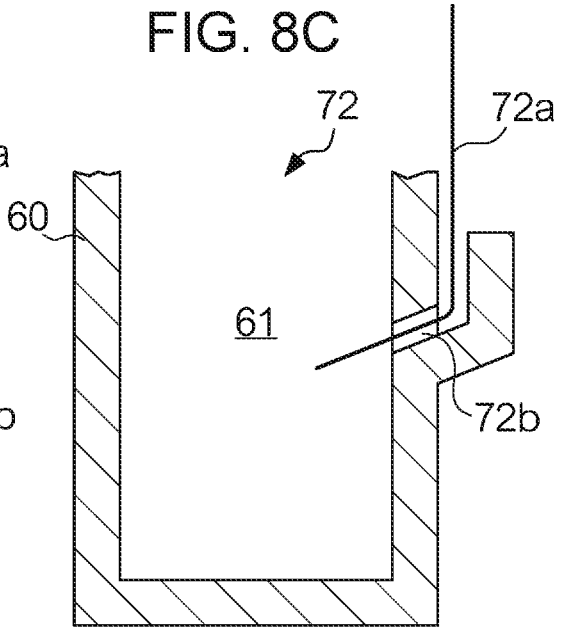

FIGS. 8A to 8C illustrate a variation of the expansion mechanism. FIG. 8A is a perspective view of the entirety of the expansion mechanism. FIGS. 8B and 8C are enlarged views (sectional views seen in the +Y direction) of an expansion mechanism 72. A separator 72*a* separates the interior of the container 60 into two spaces adjacent to each other in the Z direction. A space further to the upper side than the separator 72*a* is the first space 61, and a space further to the lower side than the separator 72*a* is the second space 62. The separator 72*a* is a film-shaped member formed of resin or the like. One side (right side of, for example, FIGS. 8B and 8C) of the separator 72*a* is exposed to the outside of the container 60 through a gap 72*b* provided in the side surface of the container 60. Three other sides disposed in the container 60 are bonded to the inner surfaces of the container 60. When the user pulls out the separator 72*a* from the gap 72*b*, the first space 61 is expanded to the second space 62 side so as to allow the toner to drop.

Second Variation

Figure 9A:
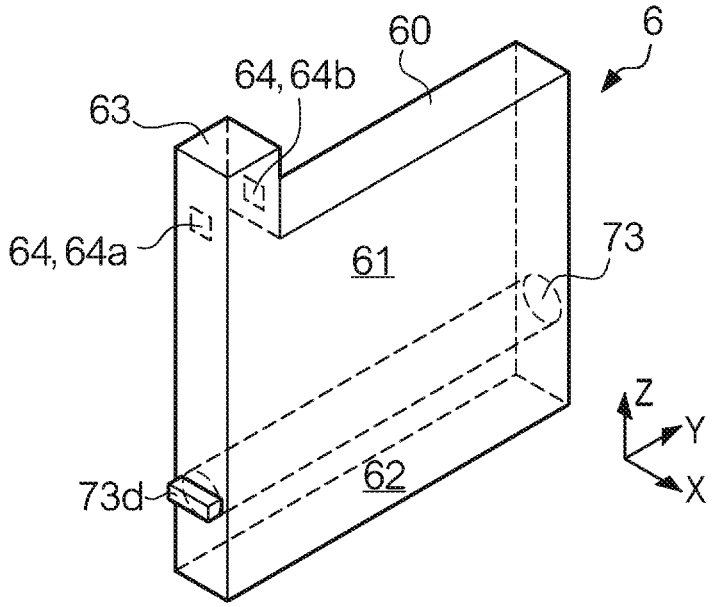
FIGS. 9A to 9C illustrate another variation of the expansion mechanism.
Figure 9B:
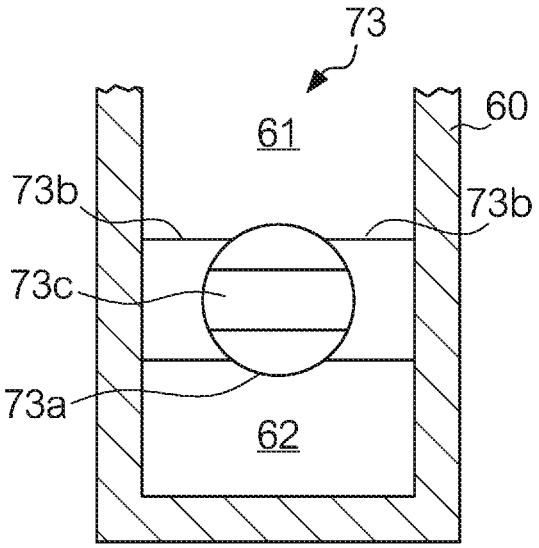
Figure 9C:
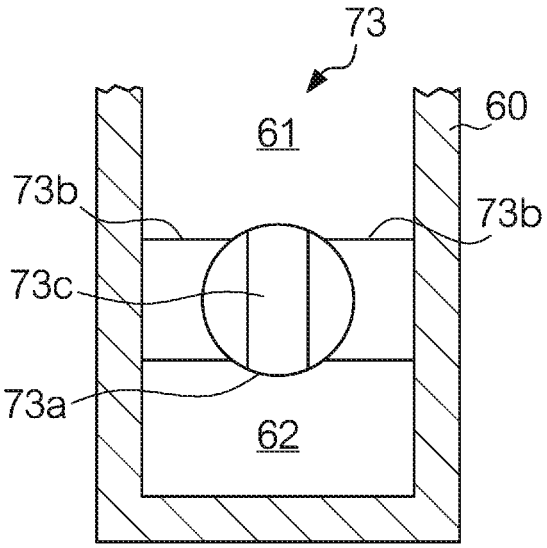

FIGS. 9A to 9C illustrate another variation of the expansion mechanism. FIG. 9A is a perspective view of the entirety of the expansion mechanism. FIGS. 9B and 9C are enlarged views (sectional views seen in the +Y direction) of an expansion mechanism 73. A separator 73*a* separates the interior of the container 60 into two spaces adjacent to each other in the Z direction. A space further to the upper side than the separator 73*a* is the first space 61, and a space further to the lower side than the separator 73*a* is the second space 62. The separator 73*a* is a circular rod-shaped member formed of resin or the like. The axial direction of the separator 73*a* extends in the Y direction. Holding members 73*b* are provided on two inner surfaces (inner surfaces on the left and right in, for example, FIGS. 9B and 9C) facing each other in the X direction with the separator 73*a* interposed therebetween. The holding members 73*b* have respective curved surfaces corresponding to an outer circumferential surface of the separator 73*a*. The curved surfaces of the holding members 73*b* are in contact with the outer circumferential surface of the separator 73*a*, so that the holding members 73*b* hold the separator 73*a*. The separator 73*a* has a hole 73*c* extending therethrough in a direction intersecting the axis thereof. In an initial state, an extending direction of the hole 73*c* is aligned with the X direction. A knob 73*d* exposed to the outside of the container 60 is provided at one end of the separator 73*a*. When the user rotates the knob 73*d* so that the extending direction of the hole 73*c* is aligned with the Z direction, the first space 61 is expanded to the second space 62 side so as to allow the toner to drop through the hole 73*c* of the separator 73*a*.

Third Variation

Figure 10A:
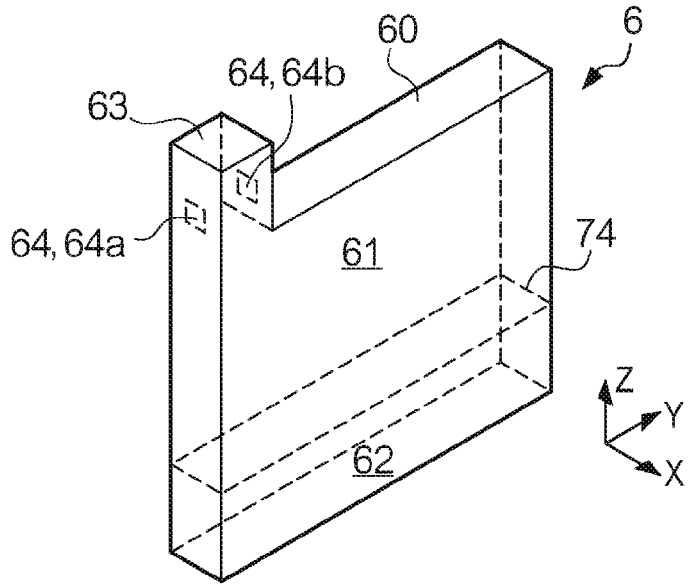
FIGS. 10A to 10C illustrate yet another variation of the expansion mechanism.
Figure 10B:
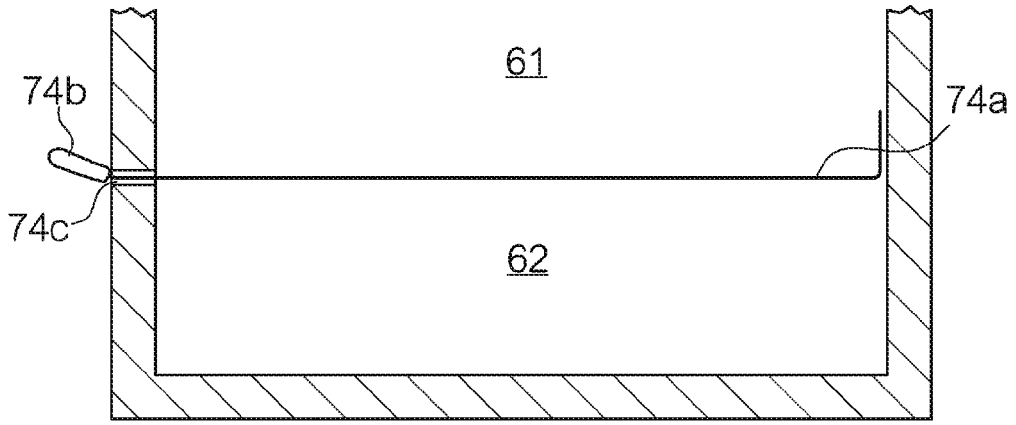
Figure 10C:
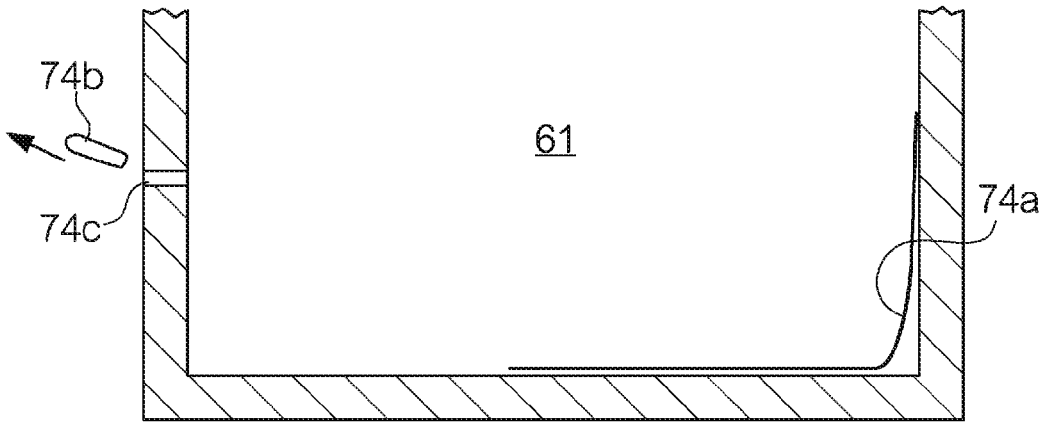

FIGS. 10A to 10C illustrate yet another variation of the expansion mechanism. FIG. 10A is a perspective view of the entirety of the expansion mechanism. FIGS. 10B and 10C are enlarged views (sectional views seen in the −X direction) of an expansion mechanism 74. A separator 74*a* separates the interior of the container 60 into two spaces adjacent to each other in the Z direction. A space further to the upper side than the separator 74*a* is the first space 61, and a space further to the lower side than the separator 74*a* is the second space 62. The separator 74*a* is a film-shaped member formed of resin or the like. A cord 74*b* is attached to one side (left side of, for example, FIGS. 10B and 10C) of the separator 74*a* and is exposed to the outside of the container 60 through a hole 74*c* provided in the side surface of the container 60. Three other sides are bonded to the inner surfaces of the container 60. When the user pulls out the cord 74*b* from the hole 74*c*, the cord 74*b* is torn off from the separator 74*a*, and the separator 74*a* drops due to the weight of the accumulated toner. Thus, the first space 61 is expanded to the second space 62 side so as to allow the toner to drop.

Fourth Variation

Figure 11A:
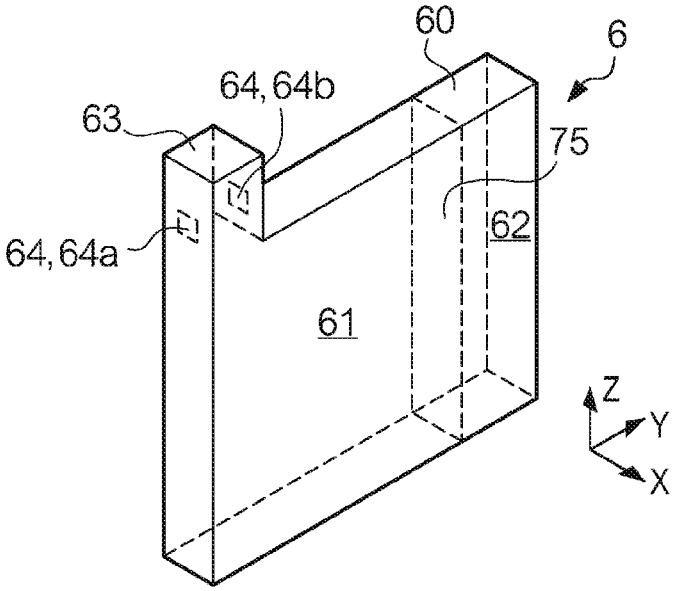
FIGS. 11A to 11C illustrate yet another variation of the expansion mechanism.
Figure 11B:
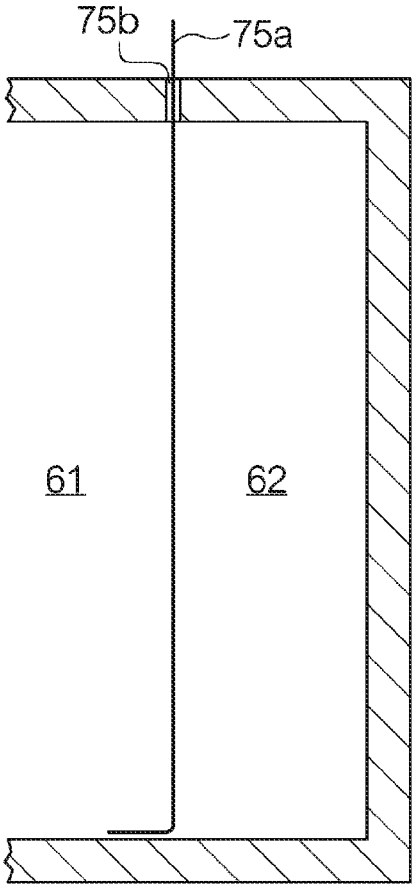
Figure 11C:
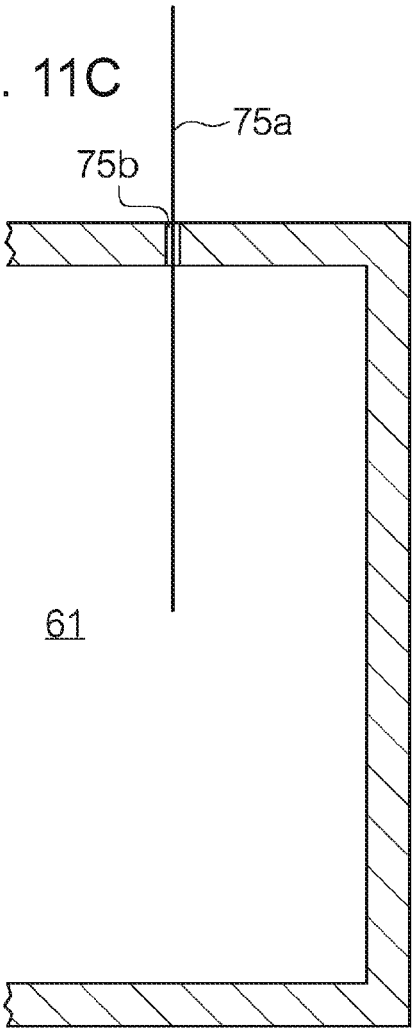

FIGS. 11A to 11C illustrate yet another variation of the expansion mechanism. FIG. 11A is a perspective view of the entirety of the expansion mechanism. FIGS. 11B and 11C are enlarged views (sectional views seen in the −X direction) of an expansion mechanism 75. A separator 75*a* separates the interior of the container 60 into two spaces adjacent to each other in the Y direction. A space further to the left side than the separator 75*a* is the first space 61, and a space further to the right side than the separator 75*a* is the second space 62. The separator 75*a* is a film-shaped member formed of resin or the like. One side (upper side of, for example, FIGS. 11B and 11C) of the separator 75*a* is exposed to the outside of the container 60 through a gap 75*b* provided in an upper surface of the container 60. Three other sides are bonded to the inner surfaces of the container 60. When the user pulls out the separator 75*a* from the gap 75*b*, the first space 61 is expanded to the second space 62 side. This moves the toner in the expanding direction, thereby allowing the toner to generally drop.

Fifth Variation

Figure 12A:
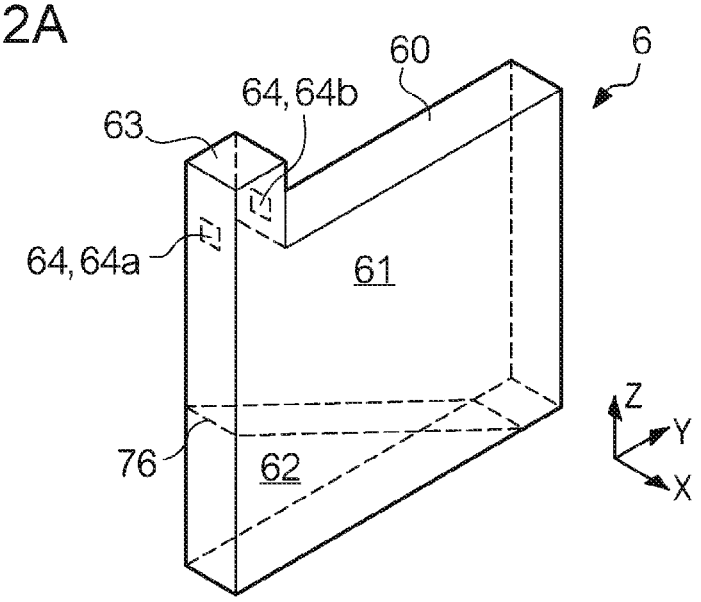
FIGS. 12A to 12C illustrate yet another variation of the expansion mechanism.
Figure 12B:
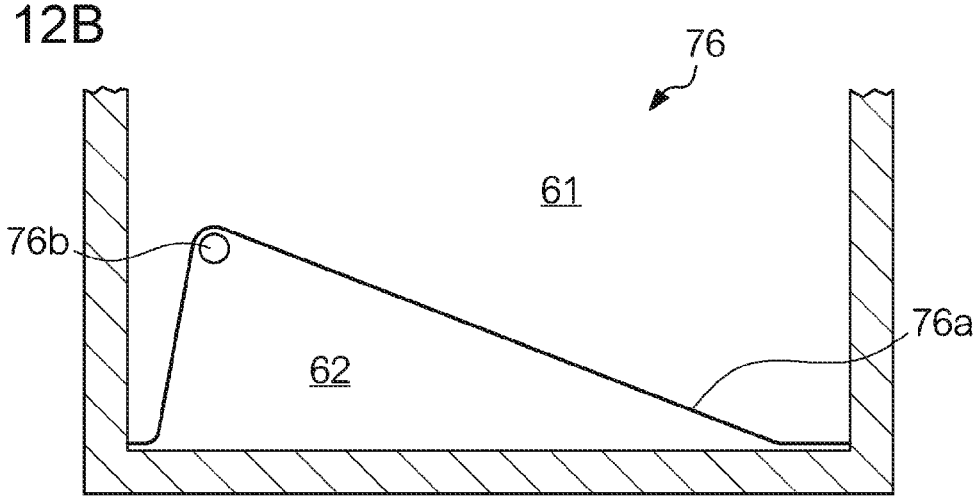
Figure 12C:
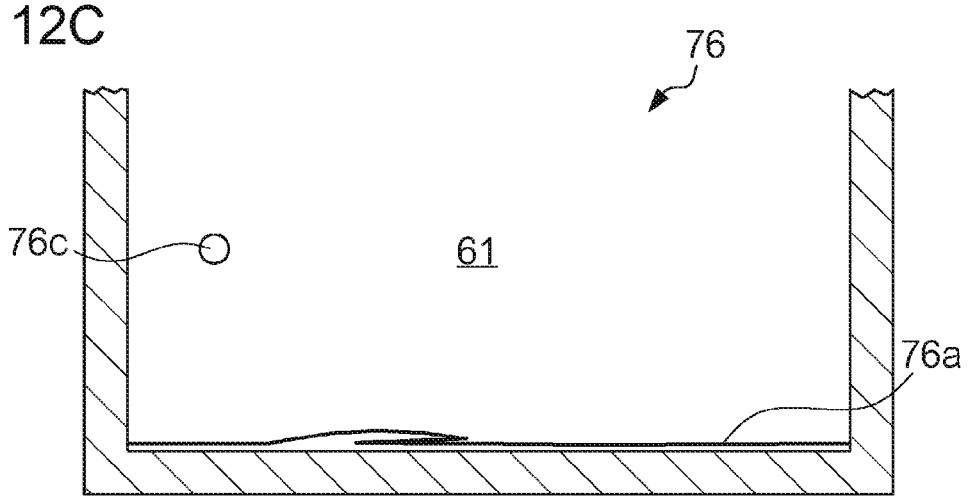

FIGS. 12A to 12C illustrate yet another variation of the expansion mechanism. FIG. 12A is a perspective view of the entirety of the expansion mechanism. FIGS. 12B and 12C are enlarged views (sectional views seen in the −X direction) of an expansion mechanism 76. A separator 76*a* separates the interior of the container 60 into two spaces adjacent to each other in a direction between the Z and Y directions. A space further to the upper right side than the separator 76*a* is the first space 61, and a space further to the lower left side than the separator 76*a* is the second space 62. The separator 76*a* is a film-shaped member formed of resin or the like. In the Y direction, the width of the separator 76*a* is larger than the width of the container 60. One and the opposite sides (right side and left side of, for example, FIGS. 12B and 12C) of the separator 76*a* are bonded to a bottom portion of the inside of the container 60. Part of the separator 76*a* between these sides is supported at a higher position than these sides by a support 76*b*. The support 76*b* is a bar-shaped member the longitudinal direction of which extends in the X direction. Both ends of the support 76*b* are supported at holes 76*c* provided in the side surfaces of the container 60. When the user pulls out the support 76*b* from the holes 76*c*, the first space 61 is expanded to the second space 62 side so as to allow the toner to drop.

Sixth Variation

Although the toner accumulated in the accumulation unit 6 is the toner removed from the holding member 11 by the removing member 17 in the example according to the above-described exemplary embodiment, powder other than this may be accumulated. For example, in the case of an image forming apparatus in which a toner image is transferred from the holding member 11 to a transfer belt and then transferred to the recording medium P, toner removed from the transfer belt may be accumulated in the accumulation unit 6. Furthermore, in the case of an image forming apparatus that includes a developing device using a trickle developing method, two-component developer (toner and carrier) discharged from the developing device may be accumulated in the accumulation unit 6. In short, the exemplary embodiment of the present invention is applicable to applications that accumulate developer discharged from image forming apparatuses. Furthermore, the exemplary embodiment of the present invention may also be applied to any apparatus that discharges powder.

Seventh Variation

In the example according to the above-described exemplary embodiment, the presence or absence of the event that the level of the toner is less than the threshold is determined in step S03 by the control unit 21. However, other events may be detected. For example, reception by the receiving unit 26 of an instruction that permits the image formation may be detected. Furthermore, the image forming apparatus may detect expansion of the first space and replacement of the container with a sensor or the like.

Eighth Variation

In the example according to the above-described exemplary embodiment, the notes that include a note urging the user to replace the container and a note urging the user to check whether or not the first space has been expanded are displayed. However, the note urging the user to replace the container and the note urging the user to check whether or not the first space has been expanded may be displayed at separate positions. For example, the note urging the user to replace the container may be displayed at such a position that this note is visible to the user when the user performs operation on the expansion mechanism 71. Furthermore, the note urging the user to check whether or not the first space has been expanded with the expansion mechanism may be displayed at such a position that this note is visible to the user when the user replaces the container 60.

Alternatively, the notes may be displayed in the display 25. In this case, a warning sound may be generated when opening of the opening/closing member 42 is detected by a sensor or the like.

Ninth Variation

The interior of the container, which is separated into two spaces in the example according to the above-described exemplary embodiment, may be divided into three or more spaces. For example, two of the expansion mechanism 71 described as the example in the exemplary embodiment may be provided at two positions of different levels. In this case, a first expansion of the first space is performed with the upper expansion mechanism 71, and a second expansion of the first space for further expanding the first space is performed with the lower expansion mechanism 71. That is, when the interior of the container is separated into N spaces with (N−1) expansion mechanisms, the amount of toner is detected at N stages (N is an integer of 2 or more).

Tenth Variation

Although the detector 64 is a photo-interrupter in the example according to the above-described present exemplary embodiment, the detector 64 may alternatively be a photo-reflector.

The detector 64 may alternatively be a device that detects a change in a vibration condition. For example, when piezoelectric ceramic is used as a sensor element and the sensor element is vibrated by an inner oscillation circuit, bringing the sensor element into contact with powder changes the vibration condition. A device that detects the powder in accordance with detection of this change may be used.

In the case where two-component developer discharged from the developing device using the trickle method is accumulated in the accumulation unit 6, the detector 64 may alternatively be a device that detects a change in magnetic permeability. For example, a device that detects a change in magnetic permeability may have a structure the same as or similar to a toner density sensor using a differential transformer method.

The detector 64 may alternatively be a device that detects a change in drive torque. For example, an impeller is provided in the opening of the container, the impeller is rotated by a motor or the like, and torque of a drive shaft is measured. When powder is accumulated to such a level that the impeller is buried in the powder, the drive torque increases compared to that before the impeller is buried. The powder is detected by this change in torque.

Eleventh Variation

Although the image forming apparatus 1 is controlled by executing the program installed in the controller 2 in the example according to the above-described present exemplary embodiment, the control may be partly or entirely performed by hardware circuitry. Alternatively, this program may be recorded in a computer readable recording medium such as an optical recording medium or a semiconductor memory and supplied, and the program may be read from the recording medium so as to be installed. This program may be supplied through an electric communication line.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An accumulation device comprising:

a container that has an opening through which the container is configured to receive powder;

an expansion mechanism that includes a separator which separates an interior of the container into a first space where the powder dropped through the opening is accumulated and a second space where the powder dropped through the opening is not accumulated and that is configured to allow the first space to be enlarged by changing a state of the separator; and a detector configured to detect the powder accumulated in the first space, wherein the detector is configured to detect, at least before the first space is enlarged, that a level of the powder accumulated in the first space has reached a threshold.

2. The accumulation device according to claim 1, further comprising:

a stopping device configured to stop the accumulation of the powder in the first space in response to a level of the powder accumulated in the first space reaching the threshold.

3. An image forming apparatus comprising:

an image forming unit configured to transfer a first image developed with developer to a medium so as to form a second image;

a container having an opening through which the container is configured to receive the developer discharged from the image forming unit;

an expansion mechanism that includes a separator which separates an interior of the container into a first space where the developer dropped through the opening is accumulated and a second space where the developer dropped through the opening is not accumulated and that is configured to allow the first space to be enlarged by changing a state of the separator; and a detector configured to detect the developer accumulated in the first space, wherein a first note urging a user to replace the container is displayed at such a position that the first note is visible to the user at least before the user performs an operation on the expansion mechanism.

4. The image forming apparatus according to claim 3, further comprising:

a stopping device configured to stop the accumulation of the developer in the first space in response to a level of the developer accumulated in the first space reaching a threshold.

5. The image forming apparatus according to claim 4, wherein a second note urging the user to check whether or not the first space has been expanded with the expansion mechanism is displayed at such a position that the second note is visible to the user at least before the user replaces the container.

6. The image forming apparatus according to claim 3, wherein a second note urging the user to check whether or not the first space has been expanded with the expansion mechanism is displayed at such a position that the second note is visible to the user at least before the user replaces the container.

7. The accumulation device according to claim 1, wherein the detector is configured to detect, before and after the first space is enlarged, that the level of the powder accumulated in the first space has reached the threshold.

8. The accumulation device according to claim 1, wherein the expansion mechanism is configured to drop the powder accumulated in the first space to the second space in response to changing the state of the separator.

9. The accumulation device according to claim 1, wherein the expansion mechanism is configured to allow the first space to be enlarged such that a level of the powder accumulated in the first space is reduced below the threshold.

10. The accumulation device according to claim 1, wherein the second space is provided under the first space such that the powder accumulated in the first space may drop to the second space.

11. The accumulation device according to claim 1, wherein the expansion mechanism includes an operation portion to be operated by a user, the operation portion being disposed at a position lower than a position of the opening.

12. The accumulation device according to claim 1, wherein the expansion mechanism is configured to allow the first space to be enlarged in response to a user pulling the separator toward an outside of the container.

13. The accumulation device according to claim 1, wherein the expansion mechanism is configured to allow the first space to be enlarged by dropping the separator into the second space.

14. The accumulation device according to claim 1, wherein the expansion mechanism is configured to allow the first space to be enlarged by connecting the first space and the second space by a hole.

15. The accumulation device according to claim 1, wherein the separator comprises a plate-shaped member, wherein the expansion mechanism comprises a hinge, and wherein the plate-shaped member is configured to, in response to a pin being pulled out through a hole in the container, rotate due to weight of the powder accumulated in the first space.

16. The accumulation device according to claim 1, wherein the separator comprises a film-shaped member, wherein the container comprises a gap exposed to an outside of the container, and wherein the gap is configured such that the separator may be pulled out through gap.

17. The accumulation device according to claim 1, wherein the separator comprises a circular rod-shaped member having a hole extending therethrough in a direction extending through an axis of the circular rod-shaped member.

18. The accumulation device according to claim 1, wherein the separator comprises a film-shaped member, wherein a cord is attached to one side of the film-shaped member, wherein the cord is exposed to an outside of the container through a hole provided in the container, and wherein the film-shaped member is configured to, in response to the cord being torn off from the film-shaped member, drop due to weight of the powder accumulated in the first space.

19. The accumulation device according to claim 1, wherein the separator comprises a film-shaped member, wherein the expansion mechanism comprises a bar-shaped member, and wherein the film-shaped member is configured to, in response to the bar-shaped member being pulled through a hole in the container, drop due to weight of the powder accumulated in the first space.

20. The image forming apparatus according to claim 3, further comprising a display configured to display the first note.

21. The image forming apparatus according to claim 3, further comprising a label configured to display the first note.

22. An accumulation device comprising:

a container that has an opening through which the container is configured to receive powder; and a means for expanding a space in the container where the powder is accumulated after dropping through the opening.

* * * * *